US005552254A

United States Patent [19]

Mychajlowsky et al.

[11] Patent Number: 5,552,254

[45] Date of Patent: Sep. 3, 1996

[54] AMIC ACID BASED TONER COMPOSITIONS

[75] Inventors: Walter Mychajlowsky, Georgetown; Guerino G. Sacripante, Oakville; T. Brian McAneney, Burlington; Richard P. N. Veregin, Mississauga, all of Canada

[73] Assignee: Xerox Corporation, Stamford, Conn.

[21] Appl. No.: 394,869

[22] Filed: Feb. 27, 1995

[51] Int. Cl.[6] ..... G03G 9/097

[52] U.S. Cl. ..... 430/109; 430/110

[58] Field of Search ..... 430/106, 109, 430/110

[56] References Cited

U.S. PATENT DOCUMENTS

| | | | |
|---|---|---|---|
| 4,513,074 | 4/1985 | Nash et al. | 430/106.6 |
| 4,543,313 | 9/1985 | Mahabadi et al. | 430/109 |
| 4,560,635 | 12/1985 | Hoffend et al. | 430/106.6 |
| 5,116,939 | 5/1992 | Fletcher et al. | 528/353 |
| 5,238,768 | 8/1993 | Ong | 430/110 |
| 5,272,248 | 12/1993 | Pratt et al. | 528/353 |
| 5,340,684 | 8/1994 | Hayase et al. | 430/165 |
| 5,348,830 | 9/1994 | Sacripante | 430/109 |
| 5,348,831 | 9/1994 | Sacripante et al. | 430/109 |

OTHER PUBLICATIONS

Encyclopedia of Polymer Science and Engineering, vol. 12, 1985, John Wiley & Sons, pp. 364 to 383.

*Primary Examiner*—John Goodrow
*Attorney, Agent, or Firm*—E. O. Palazzo

[57] ABSTRACT

A toner composition comprised of pigment and an amic acid based resin.

33 Claims, No Drawings

AMIC ACID BASED TONER COMPOSITIONS

BACKGROUND OF THE INVENTION

This invention is generally directed to toner and developer compositions, and more specifically, the present invention is directed to developer, toner plus carrier, and toner compositions containing novel amic acid based resins, and process for the preparation thereof. In embodiments, there are provided in accordance with the present invention, deinkable toner compositions comprised of polyamic acid resin or polyester amic acid resin obtained, for example, by solution or melt condensation processes, and pigment particles comprised of, for example, carbon black, magnetites, or mixtures thereof, cyan, magenta, yellow, blue, green, red, or brown components, or mixtures thereof, thereby providing for the development and generation of black and/or colored images. In embodiments, there are provided in accordance with the present invention polyamic acid resins, or mixtures thereof, and which resins are illustrated with reference to the following formula

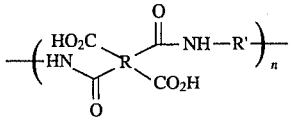

wherein R is a tetrasubstituted aromatic or aliphatic moiety with 5 and preferably 6 to 36 carbon atoms; R' is alkylene, alkyleneoxyalkylene or a poly(alkyleneoxy)alkylene group; and n represents the number of segments and is preferably a number of from about 1 to about 500; or polyester amic acid of the following formula

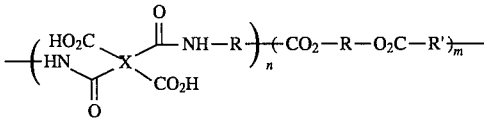

wherein X is a tetrasubstituted aromatic or cycloaliphatic group with 5 to 36 carbon atoms; R is alkylene, alkyleneoxyalkylene or poly(alkyleneoxy)alkylene; and R' is a divalent aromatic with 6 to 36 carbon atoms or aliphatic group with 2 to 20 carbon atoms; and n and m represent, respectively, the number of random segments of the polymer and are from about 10 to about 500.

The polyamic acid resin or polyester amic acid resin of this invention can also be represented in the zwitterionic form, that is a structure wherein the charges of the carboxylic and amide moeities are neutralized and represented by the formulas

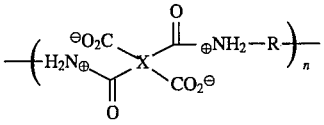

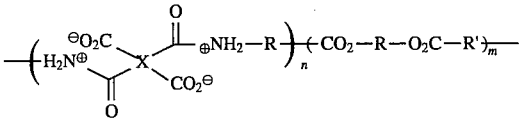

wherein X is a tetrasubstituted aromatic or cycloaliphatic group with 6 to 36 carbon atoms; R is alkylene, alkyleneoxyalkylene or poly(alkyleneoxy)alkylene; and R' is a divalent aromatic with 6 to 36 carbon atoms or aliphatic group with 2 to 20 carbon atoms; and wherein n and m respectively, represent repeating segments and can be a number of from about 10 to about 500.

In the aforementioned polyamic acid or polyester amic acid structures, the X group is a tetrasubstituted aromatic or tetrasubstituted aliphatic radical of from about 5 to 36 carbon atoms. Examples of the tetrasubstituted aromatic group, X, include radicals of cyclopentadiene, benzene, anthracene, biphenylene, diphenylene, phenanthracene, perylene, diphenyloxide, diphenylsulfoxide, diphenylhexafluoropropane, diphenylsulfone, benzophenone and the like, such as illustrated by the formulas

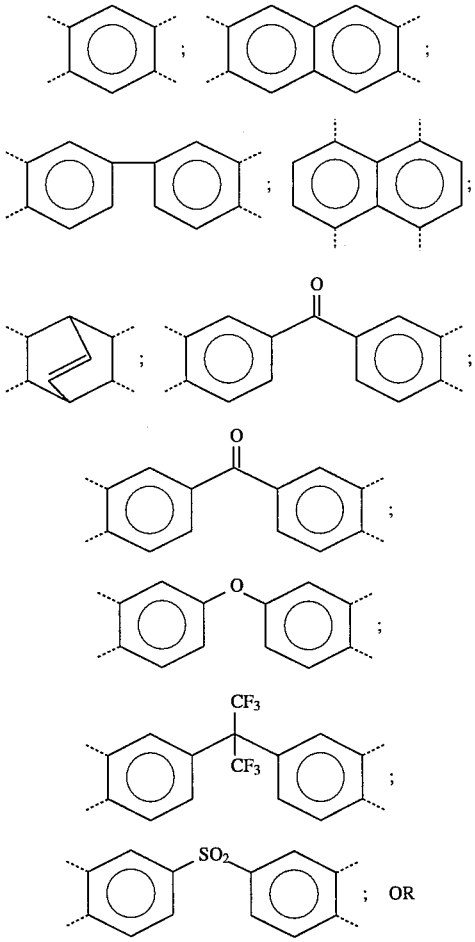

wherein the dotted lines represent covalent bonds from the radical moiety (X) to the carbonyl groups of the aforementioned amic acid resin structures.

Examples of the tetrasubstituted aliphatic groups, X, include radicals of cyclohexane, cyclopentane, 3-methyl-3-cyclohexene, bicyclo[2,2,2]octane, 4-methyl-3-cyclohexene, 1,1', 2,2'-tetramethylene ethylenediamine, mixture thereof and the like, as illustrated by the formula

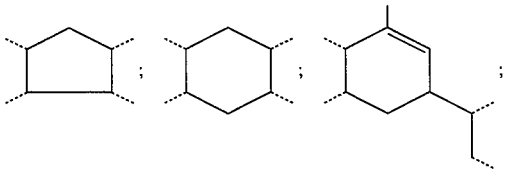

-continued

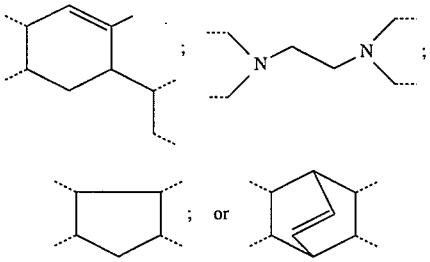

wherein the dotted lines represent covalent bonds from the radical moiety (X) to the carbonyl groups of the aforementioned amic acid resin structures. The R groups of the aforementioned amic acid based resin, include alkylene moieties of from about 2 to 25 carbon atoms such as ethylene, 1,2-propylene, 1,3-propylene, 1,3-butylene, 1,4-butylene, pentylene, hexylene, decylene, alkyleneoxyalkylene such as ethyleneoxyethylene, propyleneoxypropylene, butyleneoxybutylene, ethyleneoxyethylene oxyethylene, ethyleneoxyethyleneoxyethylene oxyethylene, propyleneoxypropylene oxypropylene, poly(alkyleneoxy)-alkylene, mixtures thereof and the like. Examples of R' of the polyester amic acid resins include disubstituted aromatic or aliphatic groups such as the divalent phenylene, anthrylene, cyclohexylene, ethylene, propylene, butylene, pentylene, naphthalylene, biphenylene, 2-methylpentylene, hexylene, octylene decylene groups, mixtures thereof and the like.

The toner compositions of the present invention in embodiments possess a number of advantages including excellent deinkability, possess low fixing characteristics such as from about 120° C. to about 145° C., excellent blocking characteristics such as from about 45° C. to about 65° C., excellent nonvinyl-offset properties, and low relative humidity sensitivities.

The polyamic acid based resins of the present invention can in embodiments be generated by the reaction of a dianhydride such as pyromellitic dianhydride, benzophenone dianhydride, 5-(2,5-dioxotetrahydrol)-3-methyl-3-cyclohexene-1,2-dicarboxylic anhydride (I) or 5-(2,5-dioxotetrahydrol)-4-methyl-3-cyclohexene- 1,2odicarboxylic anhydride (II) available as B-4400 and B-5060, respectively, from Dai Nippon Ink Company,

I

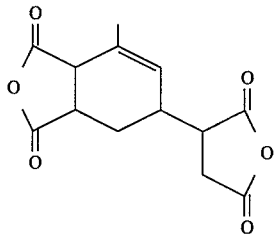

II

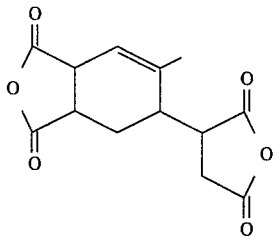

and a diamino-terminated oxyalkyl or polyoxy alkyl, such as JEFFAMINES™ available from Texaco Chemicals as JEFFAMINE D-230™, D-400™, D-700™, EDR-148™, EDR-192™ and believed to be of the following formula, or aliphatic diamines like DYTEK™.

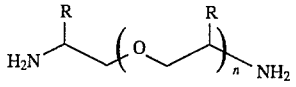

wherein

| | |
|---|---|
| EDR-148 ™ | n = 2; R = H |
| EDR-192 ™ | n = 3; R = H |
| D-230 ™ | n = 2,3; R = $CH_3$ |
| D-400 ™ | n = 5,6; R = $CH_3$. |

The aforementioned amic acid based resins exhibit in embodiments a number average molecular weight of from about 2,500 grams per mole to about 100,000 grams per mole, as measured by vapor phase osmometer, have a glass transition temperature of from about 45° C. to about 65° C., and more preferably of from about 50° C. to about 65° C. as measured by the Differential Scanning Calorimeter, low fixing characteristics, such as from about 125° C. to about 145° C., and excellent deinkability.

In embodiments, the polyamic acid resin of the present invention can be branched or crosslinked by utilizing an alkyltriamine or oxyalkyltriamine, such as JEFFAMINE T-403™ available from Texaco Company, and believed to be of the formula

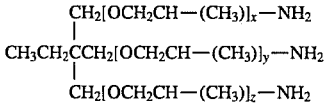

wherein the sum of x, y and z is, for example, about 5.3. The amount of branching monomer utilized is from about 0.5 to about 6 percent by weight of polyamic acid.

The polyamic acid based resins of the present invention can in embodiments be generated by the reaction of an ester dianhydride such as ethylene glycol bis-(anhydro-trimellitate), alkylene glycol bis-(anhydrotrimellitate), or glycerol bis-(anhydro-trimellitate) available as AC-32 from Anhydride Chemical Company, and represented by the formula

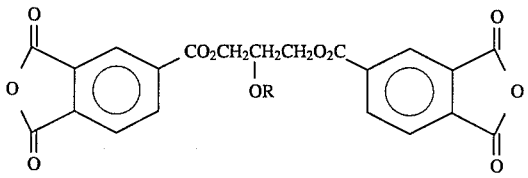

wherein R is acetyl, trimellitate anhydro and a diamino-terminated oxyalkyl or polyoxy alkyl, such as the aforementioned JEFFAMINES™ available from Texaco Chemicals.

A number of toner resins are known, such as styrene acrylates, styrene methacrylates, styrene butadienes, polyesters, polyamides, polyimides generally, polyester imides and the like.

Deinkable toner resins are disclosed in U.S. Pat. No. 5,409,793 the disclosure of which is totally incorporated herein by reference, which illustrates a toner comprised of pigment, and a polyimide-imine resin of the formula

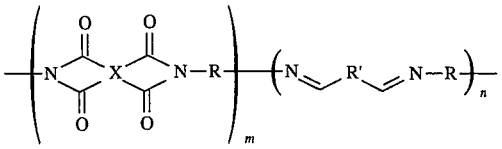

wherein m and n represent the number of monomer segments; X is independently selected from the group consisting of a tetravalent aromatic, polyarylomatic or cycloaliphatic group with from about 6 to about 20 carbon atoms and a cycloaliphatic group; R is independently selected from the group consisting of alkylene, oxyalkylene and polyoxyalkylene; and R' is independently selected from the group consisting of alkyl, alkylene and arylene. The toners of the aforementioned U. S. Pat. No. 5,409,793 can be considered deinkable in embodiments in caustic aqueous conditions of from about pH of 10 to about a pH of 14, and wherein the toner resin is believed to be decomposed to oligomers. This differs from the present invention in embodiments with regard to deinkability in that, for example, the invention polyamic acid can be deinked from paper at milder caustic conditions, such as from about pH of 8 to about a pH of 10 without surfactants, and wherein the toner resin is believed to be dissolved and not decomposed. The soluble polyamic acid resin can then be reclaimed from the process by adjusting the pH of the media below pH of 7, and more specifically from about 3 to about 6.8. The lower pH conditions for deinking also allows for less caustic reagents to be utilized.

Additionally, other deinkable polyimide or polyester imide toner resin are disclosed in U. S. Pat. No. 5,427,882, 5,413,889, 5,411,829, 5,427,881, and U.S. Pat. Nos. 5,348, 830 and 5,348,831, the disclosures of each being totally incorporated herein by reference. Similarly, these deinkable toners differ in that, for example, caustic aqueous conditions of from about pH of 10 to about a pH of 14 is necessary, whereas with the amic acid based toner resin of this invention requires less caustic reagents such that a pH of from about 8 to 10 is necessary. Some specifics of the deinking process are disclosed in copending application U.S. Ser. No. 394,990, the disclosure of which is totally incorporated herein by reference. Moreover, in copending application U.S. Ser. No. 394,974, the disclosure of which is totally incorporated herein by reference, there is illustrated a toner composition comprised of a pigment and a polyimideamic acid resin.

The disclosures of each of the above mentioned copending applications and the patents that result therefrom are totally incorporated herein by reference.

SUMMARY OF THE INVENTION

Examples of objects of the present invention include:

It is an object of the present invention to provide toner and developer compositions with many of the advantages illustrated herein.

In another object of the present invention there are provided toner compositions with certain amic acid based resins, and which toners are useful for the development of electrostatic latent images including color images.

In yet another object of the present invention there are provided processes for the preparation of certain amic acid based resins by melt condensation or solution condensation methods.

Moreover, in another object of the present invention that are provided low melting toner compositions with rapid jetting rates, and wherein such toners avoid or minimize paper curl and enable high resolution developed images.

In another object of the present invention there are provided toners with low melt fusing temperatures of from about 130° C. to about 145° C., and a broad fusing latitude of from about 30° C. to about 60° C.

Moreover, in another object of the present invention there are provided toner compositions comprised of amic acid based resin with glass transition temperature of from about 50° C. to about 65° C.

In yet another object of the present invention that are provided toner compositions comprised of amic acid based resins with a weight average molecular weight of from about 1,500 grams per mole to about 100,000 grams per mole, and a polydispersity of from about 2 to about 17 as measured by GPC.

Moreover, it is an object of the present invention to provide toners which display high gloss, such as from about 30 to about 60 gloss units as measured by the Gardner Gloss metering unit, and excellent crease characteristics.

Another object of the present invention resides in the formation of toners which will enable the development of images in electrophotographic imaging and printing apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 75 copies per minute.

It is another object of the present invention to provide deinkable toners comprised of amic acid based resins, and wherein the deinking from paper can be accomplished at mild caustic conditions such as at a pH of from about 8 to 10.

These and other objects of the present invention can be accomplished in embodiments thereof by providing toner compositions comprised of amic acid based resins of the formulas illustrated herein, and pigment particles. In embodiments, the present invention is directed to a toner composition or deinkable toners comprised of pigment, and amic acid resins of the formulas illustrated herein, or mixtures thereof. More specifically, in embodiments the present invention is directed to toner compositions comprised of pigment, optional toner additives, such as charge enhancing additives, surface additives, and the like, and an amic acid based resin as represented by the following formulas:

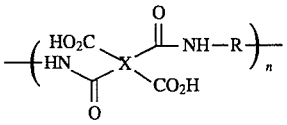

wherein X is a tetrasubstituted aromatic or tetrasubstituted aliphatic moiety with from about 5 to about 36 carbon atoms; R is alkylene, alkyleneoxyalkylene or poly(alkyleneoxy)alkylene; and wherein n represents the number of segments, or

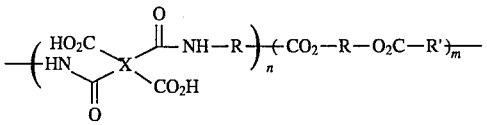

wherein X is a tetrasubstituted aromatic or tetrasubstituted cycloaliphatic group with from about 5 to about 36 carbon atoms; R is alkylene, alkyleneoxyalkylene or poly(alkyleneoxy)alkylene; R' is a divalent aromatic, cycloaliphatic or aliphatic group; and n and m represent the number of random segments of the polymer of from about 10 to about 500 for each n and m.

The polyamic acid resins of the present invention can be prepared by solution condensation process as illustrated herein, and more specifically, by charging a reactor or glass reactor equipped with a stirrer, a nitrogen inlet and optionally cooled to about 5° C. with an ice bath with from about 0.95 to about 1.05 mole of dianhydride, such as 5-(2,5-dioxotetrahydrol)-3-methyl-3-cyclohexene-1,2-dicarboxylic anhydride III, or the 5-(2,5-dioxotetrahydrol)-4-methyl-3-cyclohexene-1,2-dicarboxylic anhydride IV available as B-4400 and B-5060, respectively, from Dai Nippon Ink Chemical Company, and 0.95 to about 1.05 mole of a flexible diamine, such as a diamino-terminated polyoxypropylene available as JEFFAMINE 230™ from Texaco Chemicals, and methylene chloride or tetrahydrofuran as the solvent. The reactor is then stirred for a duration of from about 0.5 hours to about 3 hours. The reaction mixture is then precipitated in a nonpolar solvent, such as hexane, and the product is filtered off and dried. The glass transition temperature of the resin can then be measured and in embodiments is from about 45° C. to about 65° C. (onset) utilizing the 910 Differential Scanning Calorimeter available from E. I. DuPont operating at a heating rate of 10° C. per minute. The number average molecular weight can be measured by vapor phase calorimetry and in embodiments is from about 1,500 grams per mole to about 20,000 grams per mole.

Alternatively, the polyamic acid resins of the present invention can be prepared by melt condensation process as illustrated herein, and more specifically, by charging a sealed reactor equipped with a bottom drain valve, double turbine agitator and distillation receiver with a cold water condenser with from about 0.95 to about 1.05 mole of dianhydride, such as 5-(2,5-dioxotetrahydrol)-3-methyl-3-cyclohexene-1,2-dicarboxylic anhydride I or the 5-(2,5-dioxotetrahydrol)-4-methyl-3-cyclohexene-1,2-dicarboxylic anhydride II available as B-4400 and B-5060, respectively, from Dai Nippon Ink Chemical Company, and 0.95 to about 1.05 mole of a flexible diamine, such as a diamino-terminated polyoxypropylene available as JEFFAMINE 230™ from Texaco Chemicals. The reactor is then heated to from about 75° C. to about 145° C. with stirring for a duration of from about 0.5 hour to about 3 hours. The reactor is then purged with nitrogen to atmospheric pressure, and the resulting polyamic acid product is collected through the bottom drain valve. The glass transition temperature of the resin can then be measured utilizing the 910 Differential Scanning Calorimeter available from E. I. DuPont operating at a heating rate of 10° C. per minute, and in embodiments is from about 45° C. to about 65° C. (onset). The number average molecular weight can be measured by GPC and in embodiments is from about 1,500 grams per mole to about 20,000 grams per mole by vapor phase calorimetry.

Specific examples of tetraacid or dianhydride monomers that can be utilized to prepare the amic acid based resin, include 5-(2,5- dioxotetrahydrol)-3-methyl-3-cyclohexene-1,2-dicarboxylic anhydride I or the 5-(2,5-dioxotetrahydrol)-4-methyl-3-cyclohexene. 1,2-dicarboxylic anhydride II available as B-4400 and B-5060, respectively, from Dai Nippon Ink Chemical Company, pyromellitic dianhydride, benzophenone dianhydride, biphenyl dianhydride, bicyclo [2.2.2]-oct-7-ene tetracarboxylic acid dianhydride, cis, cis, cis, cis, 1,2,3,4-cyclopentane tetracarboxylic acid dianhydride, ethylenediamine tetracetic acid dianhydride, 4,4'-oxydiphthalic anhydride, 3,3',4,4'-diphenylsulfone tetracarboxylic dianhydride, ethylene glycol bis-(anhydro-trimellitate), propylene glycol bis-(anhydro-trimellitate), diethylene glycol bis-(anhydro-trimellitate), dipropylene glycol-bis-(anhydro-trimellitate), triethylene glycol-bis-(anhydro-trimellitate), tripropylene glycol-bis-(anhydro-trimellitate), tetraethylene glycol bis-(anhydro-trimellitate), or glycerol bis-(anhydro-trimellitate) available as AC-32 or AC-3205 from Anhydride Chemical Company, and mixtures thereof. These monomers are selected in various effective amounts, such as from about 0.45 mole equivalent to about 0.55 mole equivalent of the polyimide resin.

Specific examples of diamino alkanes or diamino alkylene oxides that can be selected to prepare the amic acid based resin include diaminoethane, diaminopropane, 2,3-diaminopropane, diaminobutane, diaminopentane, diamino-2-methylpentane, also known as DYTEK A™ available from DuPont Chemical Company, diaminohexane, diaminotrimethylhexane, diaminoheptane, diaminooctane, diaminononane, diaminodecane, diaminododecane, diamino-terminated ethylene oxide, diamino-terminated diethylene oxide available as JEFFAMINE EDR-148™ from Texaco Chemicals, diamino-terminated diethylene oxide available as JEFFAMINE EDR-148™ from Texaco Chemicals, diamino-terminated triethylene oxide available as JEFFAMINE EDR-192™ from Texaco Chemicals, diamino-terminated polyoxypropylene oxide available from Texaco Chemicals as JEFFAMINE D-230™, JEFFAMINE 400™, JEFFAMINE 700™, mixtures thereof, and the like. This component is selected in various effective amounts such as from about 0.45 mole equivalent to about 0.55 mole equivalent of the polyimide resin.

Specific examples of branching agent that can be utilized to prepare the amic acid based resin include JEFFAMINE T-403™ available from Texaco Chemical Company. This component is selected in various effective amounts such as from about 0.005 mole equivalent to about 0.08 mole equivalent of the amic acid based resin.

Various known colorants, especially pigments, present in the toner in an effective amount of, for example, from about 1 to about 25 percent by weight of toner, and preferably in an amount of from about 1 to about 10 weight percent that can be selected include carbon black like REGAL 330® magnetites, such as Mobay magnetites MO8029™, MO8060™; Columbian magnetites; MAPICO BLACKS™ and surface treated magnetites; Pfizer magnetites, CB4799™, CB5300™, CB5600™, MCX6369™; Bayer magnetites, BAYFERROX 8600™, 86107™; Northern Pigments magnetites, NP-604™, NP-608™; Magnox magnetites TMB-100™, or TMB-104™; and other equivalent black pigments. As colored pigments, there can be selected known cyan, magenta, yellow, red, green, brown, blue or mixtures thereof. Specific examples of pigments include HELIOGEN BLUE L6900™, D6840™, D7080™, D7020™, PYLAM OIL BLUE™ and PYLAM OIL YELLOW™, PIGMENT BLUE 1 ™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5odimethoxy-4-sulfonanilide phenylazo-4'-chloro2,5-dimethoxy acetoacetanilide, and Permanent Yellow FGL. Colored magnetites, such as mixtures of MAPICO BLACK™ and cyan, may also be selected as pigments, and are employed in effective amounts of from, for example, about 1 weight percent to about 50 weight percent of the toner.

The toner may also include known charge additives such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, such as BONTRON E-88™, available from Orient Chemicals, and the like, and these additives are present in the toner in amounts of, for example, from about 0.1 to about 5 weight percent.

Surface additives that can be added to the toner compositions of the present invention include, for example, metal salts, metal salts of fatty acids, colloidal silicas, metal oxides like tin oxides, titanium oxides, mixtures thereof and the like, which additives are usually present in an amount of from about 0.1 to about 1 weight percent, reference for example U.S. Pat. Nos. 3,590,000; 3,720,617; 3,655,374 and 3,983,045, the disclosures of which are totally incorporated herein by reference. Preferred additives include zinc stearate and fumed silicas like AEROSIL R972® available from Degussa Chemicals. Also, waxes, such as polypropylene and polyethylene, can be added to the toner in amounts of, for example, from about 0.1 to about 3 weight percent.

In embodiments of the present invention there are provided, subsequent to known micronization and classification, toner with an average volume diameter of from about 5 to about 20 microns comprised of polyamic acid resin present in an effective amount of, for example, from about 70 to about 95 weight percent, pigment particles, and optional toner components such as charge enhancing additives.

The polyamic acid resin or polyester amic acid resin is present in a sufficient, but effective amount, for example from about 70 to about 95 weight percent. Thus, when 1 percent by weight of a charge enhancing additive is present, and 8 percent by weight of pigment or colorant, such as carbon black, is contained therein, about 91 percent by weight of resin is selected. Also, the charge enhancing additive may be coated on the pigment particles.

The toner and developer compositions of the present invention may be selected for use in electrostatographic imaging apparatuses containing therein known photoreceptors. Thus, the toner and developer compositions of the present invention can be used with layered photoreceptors, including flexible layered imaging members such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

Developer compositions include carrier particles, and the polyimide toners illustrated herein, examples of carriers being steel, iron, especially iron powder, ferrites, silicon oxides, and the like, reference for example U.S. Pat. Nos. 4,937,166 and 4,935,326, the disclosures of which are totally incorporated herein by reference.

The following Examples are being provided to further define various species of the present invention, and these Examples are intended to illustrate and not limit the scope of the present invention. Parts and percentages are by weight unless otherwise indicated.

EXAMPLE I

Polyamic Acid Derived From B-4400 Dianhydride and JEFFAMINE D-230™ By Solution Condensation:

To a 3 liter 3 necked round bottom flask equipped with a nitrogen purge of 3 milliliters per second were added 26.5 grams of B-4400 dianhydride and 0.5 liter of methylene chloride. The stirred mixture was cooled in an ice-water bath, and to this were added 23 grams of JEFFAMINE-D-230™. The resulting mixture was then allowed to warm up to about room temperature and stirring was maintained for an additional 5 hours. The product was then precipitated in 3 liters of hexane, and the product filtered off and air dried. The Tg of the product material was 60° C. Molecular weight, measured by GPC against polystyrene standards, was $M_n$ 4,000 and $M_w$ 8,100.

EXAMPLE II

Polyamic Acid Derived From B-4400 Dianhydride and JEFFAMINE D-400™ By Solution Condensation Process:

To a 3 liter 3 necked round bottom flask equipped with a nitrogen purge of 3 milliliters per second were added 26.5 grams of B-4400 dianhydride and 0.5 liter of methylene chloride. The stirred mixture was cooled in an ice-water bath, and to this were added 40 grams of JEFFAMINE D400™. The mixture was then allowed to warm up to about room temperature and stirring was maintained for an additional 5 hours. The above polyamic product was then precipitated in 3 liters of hexane, and the resulting product was filtered off and air dried. The Tg (glass transition temperature) of the product was 24° C. Molecular weight, measured by GPC against polystyrene standards, was $M_n$ 4,200 and $M_w$ 8,500.

EXAMPLE III

Polyamic Acid Derived From B-4400 Dianhydride and JEFFAMINE D-230™ By Melt Condensation Process:

To a 7.6 liter Parr reactor equipped with a two blade turbine stirrer and a thermocouple were added 1,568 grams (6.82 moles) of JD 230™ (Texaco Chemicals) and 320 grams (0.8 moles) of JD-400™ (Texaco Chemicals). This mixture was stirred at 100 rpm while 2,000 grams (7.7 moles) of 5-(2,5-dioxotetrahydrol)-3-methyl-3-cyclohexene- 1,2-dicarboxylic anhydride (B-4400, Dai Nippon Ink Company) were added. An exotherm is observed which heats up the reaction mixture from 20° C. to 59° C. The reactor was sealed and heated to 75° C. Once the reaction reached 75° C., a second exotherm occurred that increased the reaction temperature to 145° C. The reaction was stirred for 30 minutes to complete the reaction and then discharged and cooled. The Tg of the product was 61° C. Molecular weight, measured by GPC against polystyrene standards was, $M_n$ 4,200 and $M_w$ 8,600. Softening point of the product, as measured on a Mettler Softening Point Instrument, was 120° C.

EXAMPLE IV

Polyamic Acid Derived From Pyromellitic Dianhydride and JEFFAMINE D-230™ By Solution Condensation Process:

To a 3 liter 3 necked round bottom flask equipped with a nitrogen purge of 3 milliliters per second were added 21.8 grams of pyromellitic dianhydride and 0.5 liter of the solvent acetone. The stirred mixture was cooled in an ice-water bath, and to this were added 23 grams of JEFFAMINE D-230™. During this time, a precipitate resulted and the mixture was permitted to warm to room temperature and then treated with the solvent methanol (250 milliliters) until a clear solution mixture was obtained. The reaction mixture was then stirred at room temperature for an additional 5 hours. The solvents were rotary evaporated off yielding 44.5 grams of the polyamic acid product. The Tg of the product was 52° C. Molecular weight, measured by aqueous GPC against sulfonated polystyrene standards, was an $M_n$ of 1,400 and an $M_w$ of 2,900 for the product.

EXAMPLE V

Polyamic Acid Derived From 2,3,2',3'-Benzophenone Dianhydride and JEFFAMINE D-230™ By Solution Condensation Process:

To a 3 liter 3 necked round bottom flask equipped with a nitrogen purge of 3 milliliters per second were added 32.2 grams of 2,3,2',3'-benzophenone dianhydride and 0.5 liter of acetone. The stirred mixture was cooled in an ice-water bath, and to this were added 23 grams of JEFFAMINE D-230™. During this time, a precipitate resulted and the mixture was allowed to warm to room temperature and then treated with methanol (250 milliliters) until a clear solution mixture was obtained. The reaction mixture was then stirred at room temperature for an additional 5 hours. The solvents were rotary evaporated off yielding 54.5 grams of polyamic acid product. The Tg of the product was 72° C. Molecular weight, measured by aqueous GPC against sulfonated polystyrene standards, was an $M_n$ of 3,600 and an $M_w$ of 8,900.

EXAMPLE VI

Polyamic Acid Derived From Bicyclo-[2,2,2]oct-7-ene-2,3,5,6-tetracarboxylic Dianhydride and JEFFAMINE D-230™ By Solution Condensation Process:

To a 3 liter 3 necked round bottom flask equipped with a nitrogen purge of 3 milliliters per second were added 24.8 grams of 2,3,2',3'-benzophenone dianhydride and 0.5 liter of acetone solvent. The stirred mixture was cooled in an ice-water bath, and to this were added 23 grams of JEFFAMINE D-230™. During this time, a precipitate resulted and the mixture was allowed to warm to room temperature and then treated with methanol solvent (250 milliliters) until a clear solution mixture was obtained. The reaction mixture was then stirred at room temperature for an additional 5 hours. The solvents were rotary evaporated off yielding 47 grams of polyamic acid product. The Tg of the product was 60.4° C. Molecular weight, measured by aqueous GPC against sulfonated polystyrene standards, was an $M_n$ of 4,100 and an $M_w$ of 8,600.

EXAMPLE VII

Polyamic Acid Derived From Ethylenediamine Tetracetic Acid Dianhydride and JEFFAMINE D-230™ By Solution Condensation Process:

To a 3 liter 3 necked round bottom flask equipped with a nitrogen purge of 3 milliliters per second were added 25.6 grams of ethylenediamine retracetic acid dianhydride and 0.5 liter of acetone. The stirred mixture was cooled in an ice-water bath, and to this were added 23 grams of JEFFAMINE-D 230™. During this time, a precipitate resulted and the mixture was allowed to warm to room temperature and then treated with methanol (250 milliliters) until a clear solution mixture was obtained. The reaction mixture resulting was then stirred at room temperature for an additional 5 hours. The solvents were rotary evaporated off yielding 48 grams of polyamic acid product. The Tg of the product was 60° C. Molecular weight, measured by aqueous GPC against sulfonated polystyrene standards, was an $M_n$ of 3,100 and an $M_w$ of 7,000.

EXAMPLE VIII

Polyamic Acid Derived From Cis,cis,.cis,cis-1,2,3,4-cyclopentane-tetracarboxylic Dianhydride and JEFFAMINE D-230™ By Solution Condensation Process:

To a 3 liter 3 necked round bottom flask equipped with a nitrogen purge of 3 milliliters per second were added 21 grams of 1,2,3,4-cyclopentane-tetracarboxylic dianhydride and 0.5 liter of acetone. The stirred mixture was cooled in an ice-water bath, and to this were added 23 grams of JEFFAMINE D-230™. During this time, a precipitate resulted and the mixture was allowed to warm to room temperature and then treated with methanol (250 milliliters) until a clear solution mixture was obtained. The reaction mixture was then stirred at room temperature for an additional 5 hours. The solvents were rotary evaporated off yielding 42.5 grams of polyamic acid product. The Tg of the product material was 58° C. Molecular weight, measured by aqueous GPC against sulfonated polystyrene standards, was an $M_n$ of 3,400 and an $M_w$ of 7,600.

EXAMPLE IX

Polyester Amic Acid Derived From Bis(anhydro-trimellitate)-glycerol Available as AC-32 and JEFFAMINE D-230™ By Solution Condensation Process:

To a 3 liter 3 necked round bottom flask equipped with a nitrogen purge of 3 milliliters per second were added 50 grams of AC-32 available from Anhydride Chemical Company, and 0.5 liter of acetone. The stirred mixture was cooled in an ice-water bath, and to this were added 23 grams of JEFFAMINE D-230™. During this time, a precipitate resulted and the mixture was allowed to warm to room temperature and then treated with methanol (250 milliliters) until a clear solution mixture was obtained. The reaction mixture was then stirred at room temperature for an additional 5 hours. The solvents were rotary evaporated off yielding 70 grams of the polyamic acid product. The Tg of the product resin material was 46° C.

EXAMPLE X

A toner composition comprised of 98 percent by weight of the polyamic acid resin of Example 8, and 2 percent by weight of PV FAST BLUE™ pigment was prepared as follows.

The polyamic acid resin of Example I was in the form of a large chunk. The resulting polymer was ground to about 500 microns average volume diameter in a Model J Fitzmill equipped with an 850 micrometer screen. After grinding, 980 grams of polymer were mixed with 20 grams of PV FAST BLUE™ pigment. The two components were dry blended first on a paint shaker and then on a roll mill. A Davo twin screw extruder was then used to melt mix the aforementioned mixture at a barrel temperature of 120° C., screw rotational speed of 50 rpm and at a feed rate of 20 grams per minute. The extruded strands were broken into coarse particles and an 8 inch Sturtevant micronizer was used to reduce the particle size further. After grinding, the toner was measured to display an average volume diameter particle size of 7 microns with a geometric distribution of 1.39 as measured by the Coulter Counter. The resulting toner was then utilized without further classification. A developer composition was prepared by roll milling the aforementioned toner, 3 parts by weight with 100 parts by weight of Xerox Corporation 9200 carrier particles comprised of a ferrite core coated with a terpolymer of methylmethacrylate, styrene, and vinyltriethoxy silane, which coating is commercially available, and wherein the coating weight was about 1.25 weight percent. The tribo data was obtained using the known blow-off Faraday Cage apparatus, and the toner developer was subjected to 20 percent humidity in a chamber for 48 hours to result in a toner triboelectric charge of −21 microcoulombs per gram, and at 60 percent humidity level in a chamber for 48 hours to result in a triboelectric toner charge of −6 microcoulombs per gram, and at 80 percent humidity level in a chamber for 48 hours to result in a toner triboelectric charge of −3.2 microcoulombs per gram. The ratio of the corresponding triboelectric charge at 20 percent RH to 80 percent RH was measured to be about 6.5. Unfused copies were then produced with a customized Xerox Corporation MAJESTIK™ test copier with the fusing system disabled and at a room relative humidity of about 50 percent. The unfused copies were then subsequently fused with a Xerox Corporation MAJESTIK™ color fuser. Fusing evaluation of the toner indicated a minimum fixing temperature of about 137° C. and a hot-offset temperature of 200° C.

Other modifications of the present invention may occur to those skilled in the art subsequent to a review of the present application and these modifications, including equivalents thereof, are intended to be included within the scope of the present invention.

What is claimed is:

1. A toner composition consisting essentially of pigment and a polyamic acid based resin.

2. A toner composition comprised of pigment, a polyamic acid based resin, and a charge control agent.

3. A toner composition in accordance with claim 1 wherein the amic acid based resin is a polyamic acid.

4. A toner composition in accordance with claim 1 wherein the polyamic acid based resin is a polyester amic acid.

5. A toner composition in accordance with claim 1 wherein the polyamic acid based resin is comprised of an about equal amount of at least one carboxylic acid group and at least one amide group.

6. A toner composition in accordance with claim 1 wherein the amic acid based resin is represented by the following alternative formulas

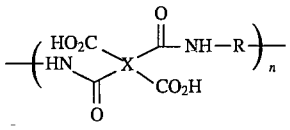

wherein X is a tetrasubstituted aromatic or tetrasubstituted aliphatic moiety with from about 5 to about 36 carbon atoms, R is alkylene, alkyleneoxyalkylene or poly(alkyleneoxy)alkylene, and wherein n represents the number of segments; or

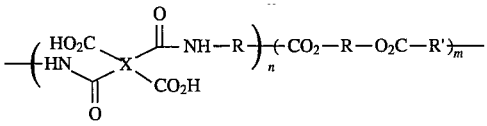

wherein X is a tetrasubstituted aromatic or tetrasubstituted cycloaliphatic group with from about 5 to about 36 carbon atoms, R is alkylene, alkyleneoxyalkylene or poly(alkyleneoxy)alkylene, R' is a divalent aromatic, cycloaliphatic or aliphatic group, and n and m represent the number of random segments of the polymer, which number is from about 10 to about 500 for each n and m.

7. A toner composition in accordance with claim 1 wherein the amic acid based resin is branched or crosslinked.

8. A toner composition in accordance with claim 6 wherein the X tetrasubstituted cycloaliphatic or tetrasubstituted aromatic is represented by the formulas

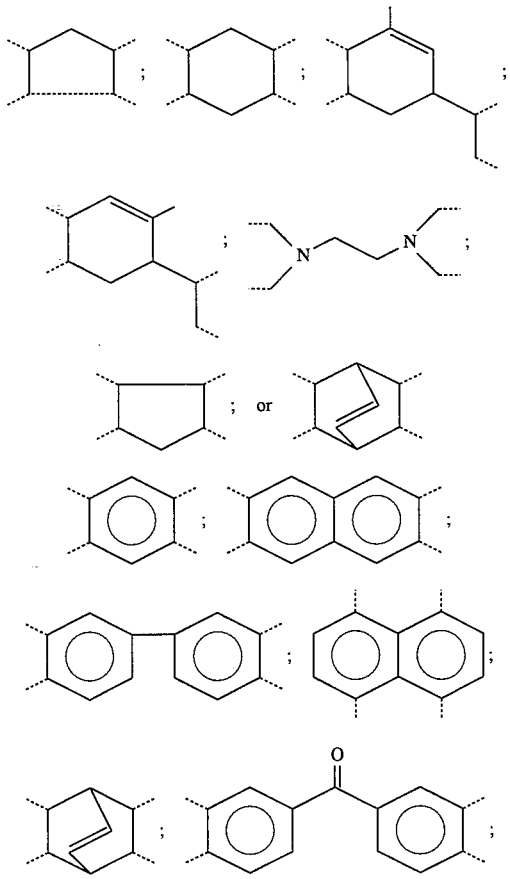

-continued

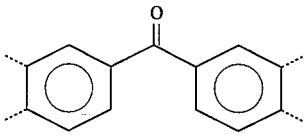

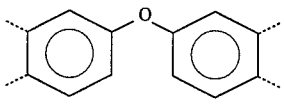

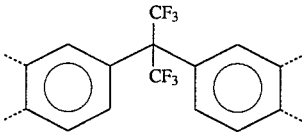

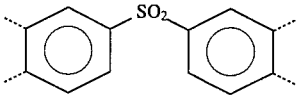

wherein the dotted lines represent the covalent bonds from said radical to the carbonyl groups of the amic acid.

9. A toner composition in accordance with claim 6 wherein R is alkylene, alkyleneoxyalkylene or polyalkyleneoxyalkylene with from 1 to about 35 carbon atoms.

10. A toner composition in accordance with claim 6 wherein R is methylene, ethylene, propylene, butylene, pentylene, hexylene, heptylene, octylene, nonyl, decylene, undecylene, dodecylene, stearylene, laurylene, ethyleneoxyethylene, propyleneoxypropylene, ethyleneoxyethyleneoxyethylene, propyleneoxypropyleneoxypropylene, poly(ethyleneoxy)ethylene, poly(propyleneoxy)propylene or mixtures thereof.

11. A toner composition in accordance with claim 6 wherein R' is phenylene, naphthylene, cyclohexylene, anthrylene ethylene, propylene, butylene, pentylene, hexylene, heptylene, octylene, nonyl, decylene, undecylene, dodecylene, stearylene, laurylene, or mixtures thereof.

12. A toner composition in accordance with claim 1 wherein the amic acid based resin is zwitterionic.

13. A toner composition in accordance with claim 12 wherein the zwitterionic amic acid resin is represented by the formulas

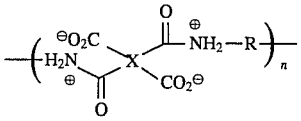

wherein X is a tetrasubstituted aromatic or tetrasubstituted aliphatic group moiety with from about 5 to 36 carbon atoms, and R is alkylene, alkyleneoxyalkylene, or poly(alkyleneoxy)alkylene group, and n represents the number of segments and is from about 10 to about 500; or

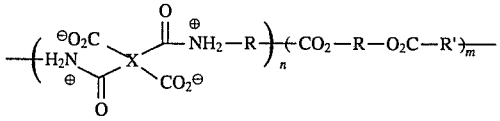

wherein X is a cycloaliphatic group with from about 5 to about 36 carbon atoms, R is alkylene, alkyleneoxyalkylene or poly(alkyleneoxy)alkylene; R' is a divalent aromatic, cycloaliphatic or aliphatic group, and n and m represent the number of random segments of the polymer of from about 10 to about 500 for each of said n and m.

14. A toner composition in accordance with claim 1 wherein the amic acid based is comprised of a polymer with equal amounts of at least one carboxylic acid group and at least one amide group, and at least one ester group.

15. A toner composition in accordance with claim 1 wherein the amic acid based resin is comprised of a polymer which is comprised of at least one ester group, one thioester group, or one imino group, and equal amounts of at least one carboxylic acid group and at least one amide group.

16. A toner composition in accordance with claim 1 wherein the amic acid based resin is selected in an amount of from about 65 percent by weight to about 98 percent by weight of toner.

17. A toner composition in accordance with claim 1 wherein the amic acid based resin has a $M_n$ of from about 1,500 to about 40,000, an $M_w$ of from about 10,000 to about 200,000, and a polydispersity of from about 1.5 to about 10.

18. A toner composition in accordance with claim 1 which possesses a low fixing temperature of from about 120° C. to about 155° C., and a broad fusing latitude of from about 30° C. to about 120° C.

19. A toner composition in accordance with claim 1 wherein the amic acid based resin is obtained from the reaction of from about 0.40 mole equivalent to about 0.55 mole equivalent of an acid dianhydride, from about 0.40 mole equivalent to about 0.55 mole equivalent of a diamine, and optionally of from about 0.00 to about 0.1 of branching or crosslinking agent.

20. A toner composition in accordance with claim 19 wherein the acid dianhydride is selected from the group consisting of 5-(2,5-dioxotetrahydrol)-3-methyl-3-cyclohexene-1,2-dicarboxylic anhydride, 5-(2,5-dioxotetrahydrol)-4-methyl-3-cyclohexene- 1,2-dicarboxylic anhydride, pyromellitic dianhydride, benzophenone dianhydride, biphenyl dianhydride, bicyclo[2.2.2]-oct-7-ene tetracarboxylic acid dianhydride, cis,cis,cis,cis, 1,2,3,4-cyclopentane tetracarboxylic acid dianhydride, ethylenediamine tetracetic acid dianhydride, 4,4'-oxydiphthalic anhydride, 3,3',4,4'-diphenylsulfone tetracarboxylic dianhydride, ethylene glycol bis-(anhydro-trimellitate), propylene glycol bis-(anhydro-trimellitate), diethylene glycol bis-(anhydro-trimellitate), dipropylene glycol bis-(anhydro-trimellitate), triethylene glycol bis-(anhydro-trimellitate), tripropylene glycol bis-(anhydro-trimellitate), tetraethylene glycol bis-(anhydro-trimellitate), glycerol bis-(anhydro-trimellitate), and mixtures thereof.

21. A toner composition in accordance with claim 19 wherein the diamine is selected from the group consisting of diaminoethane, diaminopropane, 2,3-diaminopropane, diaminobutane, diaminopentane, diamino-2-methylpentane, diaminohexane, diamino-trimethylhexane, diaminoheptane, diaminooctane, diaminononane, diaminodecane, diaminododecane, diamino-terminated diethyleneoxide, diamino-terminated triethyleneoxide, and a polyoxyalkylene of the formula

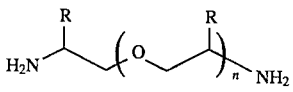

wherein R represents a hydrogen or alkyl group, and n represents the number of monomer segments and is a number of from about 1 to about 10.

22. A toner composition in accordance with claim 1 with a glass transition temperature thereof of from about 50° C. to about 65° C., and a relative humidity sensitivity of from about 1.01 to about 3.0.

23. A toner composition in accordance with claim 1 further including a charge enhancing additive incorporated into the toner, or present on the surface of the toner, and further containing a wax component with a weight average molecular weight of from about 1,000 to about 10,000.

24. A toner composition in accordance with claim 1 further containing external additives of metal salts of a fatty acid, colloidal silicas, or mixtures thereof.

25. A toner composition in accordance with claim 1 wherein the pigment is carbon black, magnetites, or mixtures thereof; cyan, magenta, yellow, red, blue, green, brown, or mixtures thereof.

26. A developer composition comprised of the toner composition of claim 1 and carrier particles.

27. A developer composition in accordance with claim 26 wherein the carrier particles are comprised of a core of ferrites, steel, or an iron powder with an optional coating, or mixture of coatings thereover.

28. A method of imaging which comprises formulating an electrostatic latent image on a photoconductive imaging member, affecting development thereof with the toner composition of claim 1, and thereafter, transferring the developed image to a suitable substrate.

29. A toner composition in accordance with claim 7 wherein the amic acid based is branched or crosslinked with a tri or multifunctional monomer.

30. A toner composition in accordance with claim 29 wherein the tri or multifunctional monomer is selected from the group consisting of trimethylolpropane, pentaerythritol, and a triamine of the formula

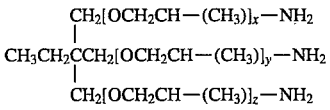

said trifunctional or multifunctional monomer selected in amounts of from about 0.005 to about 0.08 mole percent by weight of polyamic acid, and wherein x, y and z are equal to about 5.3.

31. A toner composition consisting essentially of pigment particles and a polyamic acid based resin, and wherein the polyamic acid based resin is represented by the following alternative formulas

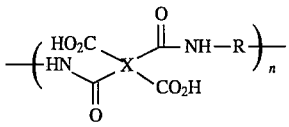

wherein X is a tetrasubstituted aromatic or tetrasubstituted aliphatic moiety with from about 5 to about 36 carbon atoms, R is alkylene, alkyleneoxyalkylene or poly(alkyleneoxy)alkylene, and wherein n represents the number of segments of from about 10 to about 500; or

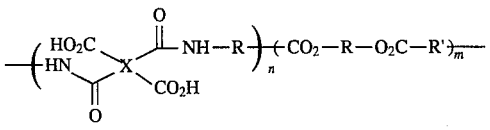

wherein X is a tetrasubstituted aromatic or tetrasubstituted cycloaliphatic group with from about 5 to about 36 carbon atoms, R is alkylene, alkyleneoxyalkylene or poly(alkyleneoxy)alkylene, R' is a divalent aromatic, cycloaliphatic or aliphatic group, and n and m represent the number of random segments of the polymer of from about 10 to about 500 for each said n and m.

32. A toner composition consisting essentially of pigment and a polyamic acid based resin, and wherein said polyamic acid based resin is represented by the following alternative formulas

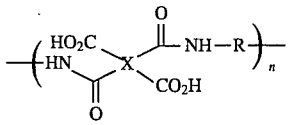

wherein X is a tetrasubstituted aromatic or tetrasubstituted aliphatic moiety with from about 5 to about 36 carbon atoms, R is alkylene, alkyleneoxyalkylene or poly(alkyleneoxy)alkylene, and wherein n represents the number of segments; or

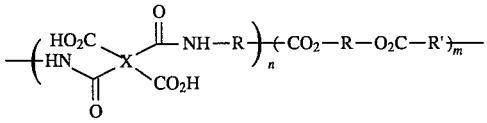

wherein X is a tetrasubstituted aromatic or tetrasubstituted cycloaliphatic group with from about 5 to about 36 carbon atoms, R is alkylene, alkyleneoxyalkylene or poly(alkyleneoxy)alkylene, R' is a divalent aromatic, cycloaliphatic or aliphatic group, and n and m represent the number of random segments of the polymer, which number is from about 10 to about 500 for each n and m.

33. A toner composition consisting of pigment and a polyamic acid based resin, and wherein said polyamic acid based resin is represented by the following alternative formulas

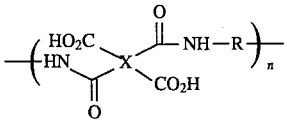

wherein X is a tetrasubstituted aromatic or tetrasubstituted aliphatic moiety with from about 5 to about 36 carbon atoms, R is alkylene, alkyleneoxyalkylene or poly(alkyleneoxy)alkylene, and wherein n represents the number of segments; or

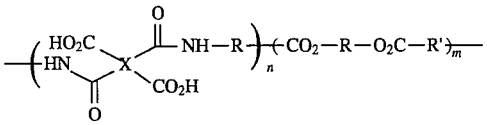

wherein X is a tetrasubstituted aromatic or tetrasubstituted cycloaliphatic group with from about 5 to about 36 carbon atoms, R is alkylene, alkyleneoxyalkylene or poly(alkyleneoxy)alkylene, R' is a divalent aromatic, cycloaliphatic or aliphatic group, and n and m represent the number of random segments of the polymer, which number is from about 10 to about 500 for each n and m.

* * * * *